United States Patent [19]

Coffey

[11] Patent Number: 4,720,332

[45] Date of Patent: Jan. 19, 1988

[54] NICKEL STRIP FORMULATION

[76] Inventor: Barry W. Coffey, Rte. 10, Box 683, Lenoir, N.C.

[21] Appl. No.: 854,309

[22] Filed: Apr. 21, 1986

[51] Int. Cl.[4] ..... C25F 5/00

[52] U.S. Cl. ..... 204/146; 252/79.4

[58] Field of Search ..... 204/146; 252/79.4

[56] References Cited

U.S. PATENT DOCUMENTS

| | | | |
|---|---|---|---|
| 2,200,782 | 5/1940 | Vollmer | 204/57 |
| 2,649,361 | 8/1953 | Springer et al. | 41/42 |
| 2,698,781 | 1/1954 | Meyer | 41/42 |
| 3,203,787 | 8/1965 | Grunwald | 75/97 |
| 3,245,780 | 4/1966 | Weisberg et al. | 75/103 |
| 3,365,401 | 1/1968 | Saubestre et al. | 252/149 |
| 3,649,489 | 3/1972 | Dillenberg | 204/146 |
| 4,111,767 | 9/1978 | Kawagishi | 204/146 |

*Primary Examiner*—Arthur P. Demers

*Attorney, Agent, or Firm*—Cushman, Darby & Cushman

[57] ABSTRACT

The present invention relates to the chemical stripping of nickel and nickel alloys from metallic and non-metallic substrates wherein at least one compound that is, or can form in solution, a zwitterion acts as a complexing agent for the metal being dissolved and as a buffer to control the pH of the stripping solution. The present invention discloses an electrical method for the rapid stripping of high-phosphorus electroless nickel plating. The present invention provides an electrical process for the efficient removal of the residual smut that ensues from the sulfide ion catalysis of the chemical stripping process.

44 Claims, No Drawings

NICKEL STRIP FORMULATION

BACKGROUND OF THE INVENTION

1. Field of the Invention

The present invention relates to an improved composition for and method of stripping nickel and nickel alloys from metallic and non-metallic substrates. More particularly, the present invention relates to a stripping composition comprising at least one compound that is, or can form in solution, a zwitterion which acts as a complexing agent for the metal being dissolved as well as a buffer to control the pH of the stripping solution.

The present invention provides an electrical process for the removal of high-phosphorus electroless nickel plating from an article wherein the stripping solution itself is utilized in the application of a reverse current to said plated article. Stripping proceeds at the more rapid rate expected in the case of a nickel coating containing no phosphorus.

The present invention provides an electrical process for the removal from an article stripped of nickel of the residual smut that ensues from sulfide ion catalysis of the chemical stripping process. The electrical process according to the present invention utilizes the stripping solution itself at a low cost and without the use of hazardous chemicals.

2. Description of the Prior Art

Reclamation of fabricated articles by removal of defective nickel and nickel alloy plating is of significant economic importance to manufacturers. Accordingly, an inexpensive, easily controllable and enviromentally acceptable means of stripping unsatisfactory coatings is needed.

Methods and compositions suitable for removing nickel and nickel alloys from metallic and non-metallic substrates are well known in the art. Some of these stripping compositions incorporate strongly acidic systems which attack the substrate as well as the plating. More successful formulations are in the alkaline pH range; stripping solutions maintained at alkaline pH levels are particularly useful for stripping nickel from ferrous substrates which are rapidly attacked in acidic environments. To attain the proper alkaline range, prior formulations have had to utilize amines, cyanides or ammonia-containing compounds to complex the nickel.

The use of amines, cyanides or ammonia-containing compounds in the stripping solution according to the conventional method has certain drawbacks. Of particular importance in all stripping processes incorporating these compounds is the disposal of the spent stripping solution. Most disposal requirements include expensive ion exchange or oxidation methods which leave the operator with a residual nickel-free solution which still poses a high environmental liability as well as the additional expense of legal disposal. Furthermore, amines, cyanides and ammonia-containing compounds are all volatile at the economic operating temperatures of the stripping solution; essential ingredients are therefore lost through the volatilization process. Additionally, incorporation of cyanide compounds into the stripping solution composition introduces health hazards inherent in systems employing cyanide compounds.

The present invention is directed to a novel stripping composition which avoids the health hazards inherent in systems employing cyanides and which dramatically reduces the environmental problems involved in the disposal of the spent stripping bath by the elimination of the hazardous amines, cyanides and ammonia-containing compounds, while providing a stripping solution which may be used in the protective alkaline pH range.

Central to the present invention is the novel use of compounds that form zwitterions. A zwitterion, or dipolar ion, is an inner salt which is the product of a reaction between an acidic group and a basic group that are part of the same molecule, wherein the hydrogen attaches to the stronger base. Dipolar ions may be expected when a molecule contains an amine and an acid group if the amine is more basic than the acid's anion.

Zwitterions are found in nature in the form of proteins. Aminocarboxylic acid zwitterions commonly available on the market include betaalanine, alanine, glycine, valine, isoleucine, leucine, methionine and monosodium glutamate. The general structural formulas follow:

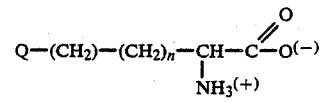

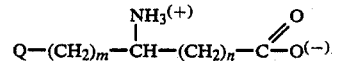

Where:

Q=$NH_2$, OH, COOH, or H n=0–6 m=0–6

Surprisingly, zwitterions may be mixed with carbonates of sodium or potassium without any evolution of carbon dioxide, thereby creating the necessary conditions to strip metal in alkaline solution. The zwitterion acts as a complexing agent for the metal being dissolved as well as a buffer to control the pH.

The stripping solution described in the present invention works very quickly and with much greater operator safety than any stripping formulation disclosed in the prior art. The present invention provides a composition wherein the stripping process may be operated at significantly higher temperatures without production of hazardous fumes and without loss of essential ingredients through the volatilization that occurs in conventional compositions which utilize amines, cyanides and ammonia-containing compounds to complex the metal. A further advantage offered by the present composition is the option to increase the temperature of the bath to close to boiling point or to boiling point and thereby accelerate the stripping action and so increase productivity without chemical hazard to the operator.

An additional safety advantage of the present invention is that the composition is in a safe, solid, dry powder form that is not toxic to ship or store. Therefore, possible chemical hazards such as those brought about by, for example, accidental puncturing of the cannister are obviated.

According to the present invention, any one of several methods may be used to recover the dissolved nickel from the spent stripping solution, i.e., ion exchange, sulfide precipitation, pH precipitation, or preferably, direct electrochemical recovery using a diaphram cell. The residual solution is, unlike the solution prepared according to the conventional methods, free from hazardous amines, cyanides or ammonia-containing compounds and is acceptable for Public Treatment Works disposal.

The prior art does not disclose an efficient method for the removal of high-phosphorus electroless nickel plating. As stripping proceeds according to the conventional method, phosphorus from the plate forms a non-soluble film that halts further stripping. The present invention for the first time discloses a method for high-phosphorus electroless nickel stripping wherein an electrical current is applied to said plated article, stripping the phosphorus and causing it to go into solution. Stripping proceeds at the rapid rate expected in the case of a nickel coating containing no phosphorus.

The prior art does not disclose an efficient method for the removal of residual smut from stripped articles that ensues from sulfide ion catalysis of the chemical stripping process. The present invention provides an electrical process, utilizing the stripping solution itself at low cost to the consumer, which removes smut without use of hazardous chemicals such as cyanide or chromium compounds.

SUMMARY OF THE INVENTION

The present invention relates to an improved composition for and method of stripping nickel and nickel alloys from metallic and non-metallic substrates wherein the plated articles are immersed in an aqueous bath consisting essentially of:

(1) a complexing agent and buffer in the form of a zwitterion,
(2) an oxidizing agent in the form of an organic nitro compound,
(3) a pH-adjusting compound selected from the group consisting of a soluble salt that forms an alkaline solution when dissolved in water, potassium hydroxide and sodium hydroxide, to adjust the stripping solution to an operating pH range of 7 to 11,
(4) a compound that forms the sulfide ion in solution to act as a catalyst in the chemical stripping process, and
(5) when stripping nickel-iron coatings, a compound from the family of hydroxycarboxylic acids and/or polyphosphates and/or polyols to form an iron complexor. Monosaccharides may also be used to form an iron complexor.

According to the present invention, the metallic or non-metallic article plated with nickel or a nickel alloy is immersed in the prepared stripping solution at temperatures ranging from room temperature to 150° F. for time periods ranging from ½ hour to 24 hours.

Any one of several methods may be used to recover the dissolved nickel from the spent stripping solution, i.e., ion exchange, sulfide precipitation, pH precipitation, or preferably, direct electrochemical recovery using a diaphragm cell.

The present invention provides an electrical process for the removal of high-phosphorus electroless nickel plating from an article wherein the stripping solution itself is utilized in the application of a reverse current of 2 or more volts to said plated article. Stripping proceeds at the rapid rate expected in the case of a nickel coating containing no phosphorus.

The present invention provides an electrical process for the removal from an article stripped of nickel of the residual smut that ensues from sulfide ion catalysis of the chemical stripping process. In accordance with the present invention, the stripped article is reverse-plated in the stripping solution itself using the stripped article as the anode and the tank as the cathode.

DESCRIPTION OF THE PREFERRED EMBODIMENTS

According to the present invention, at least one compound that is, or can form in solution, a zwitterion, acts as a complexing agent for the metal being dissolved as well as a buffer to control the pH of the stripping solution. Any suitable zwitterion may be used, such as, for example, betaalanine and monosodium glutamate, two zwitterions commonly available on the market. Other aminocarboxylic acid zwitterions may also be used, e.g., glycine, valine, isoleucine, leucine, methionine and alanine.

The concentration of the zwitterion compound in the stripping solution may range from 0.01 lbs./gal. to saturation; however, the preferred concentration range is from 0.5 lbs./gal. to 1.5 lbs./gal.

While any suitable soluble organic nitro compound may be used, ortho-, meta-, and para-nitrobenzene sulfonic acids and their salts, e.g., sodium and potassium salts, and othor-, meta-, and para-nitrobenzoic acids and their soluble salts, e.g., sodium and potassium salts, are preferably used. The benzene ring may have multiple nitro compounds attached; however, from an availability standpoint, the single nitro compounds are preferred. Suitable nitrobenzene compounds are described in U.S. Pat. No. 2,200,782, U.S. Pat. No. 2,649,361, U.S. Pat. No. 2,698,781, and U.S. Pat. No. 3,203,787, the disclosures of which are hereby incorporated by reference and relied upon.

Any suitable soluble nitro naphthalene compound may be used as the oxidizing agent. However, limited availability and high cost usually preclude their use.

The concentration of the organic nitro compound in the stripping solution may range from 0.01 lbs./gal. to saturation; however, the preferred concentration range is from 0.25 lbs./gal. to 1.0 lbs./gal.

Any suitable soluble salt that forms an alkanine solution when dissolved in water may be used. Suitable soluble salts include, for example, sodium or potassium carbonate, potassium phosphate, disodium phosphate, trisodium phosphate, tripotassium phosphate, dipotassium phosphate and sodium tetraborate. Sodium and potassium carbonate are preferred.

The concentration of the soluble salt in the stripping solution may range from 0.01 lbs./gal. to saturation, up to a pH of 11; however, the preferred concentration range is from 0.5 lbs./gal. to 1.5 lbs./gal.

While sodium hydroxide or potassium hydroxide may be used to form an alkaline solution, soluble salts are much preferred. When sodium hydroxide or potassium hydroxide is used as the pH-adjusting compound, the pH of the solution is difficult to control, making it difficult to stay under the required limit of a pH of 11. In addition, the presence of NaOH or KOH in the powder may be hazardous to the operator. Grinding of nitrobenzene compounds with sodium or potassium hydroxide presents a fire hazard. Finally, sodium hydroxide and potassium hydroxide tend to absorb moisture from the air and so cause unwanted caking of the powder.

Surprisingly, it was discovered that sodium carbonate may be used to give the required high pH without destroying the other materials, e.g., glycine or beta-alanine. Caustic soda creates a problem because it forms sodium glycinate and water.

The sulfide ion is utilized as a stripping rate catalyst as described in U.S. Pat. No. 3,245,780 and U.S. Pat. No. 3,365,401, the disclosures of which are hereby incorporated by reference and relied upon. The preferred sulfide ion compound for dry formulation is sodium or potassium thiosulfate.

The concentration of the sulfide ion compound in the stripping solution may range from 1 ppm to 5 oz./gal. However, the preferred concentration range is from 1 oz./gal. to 3 oz./gal.

When nickel-iron deposits are to be stripped, a hydroxycarboxylic acid and/or a polyphosphate and/or a polyol is used to form an iron complexor to handle the iron that is to be dissolved in the alkaline stripping solution. Monosaccharides, although less desirable because they tend to react with the oxidizing agent, may also be used to form an iron complexor. Suitable hydroxycarboxylic acids include glycolic acid, tartaric acid, malic acid, alpha- and beta-hydroxypropionic acid, citric acid, glucuronic acid and lactic acid. Suitable polyphosphates include sodium polyphosphate, sodium metaphosphate, sodium tripolyphosphate and sodium pyrophosphate. Suitable polyols include glycerine, mesoerythritol, sorbitol, mannitol. Although not preferred, monosaccharides such as fructose and glucose may be used. Sodium gluconate and disodium tartarate are preferred iron complexors; potassium sodium tartarate and disodium malate may also be used.

The structural formulas for the iron complexors follow:

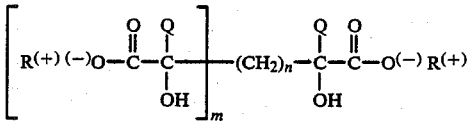

where:
Q=COO(−)R(+) or H
R=Na or K
n=0–10
m=0 or 1; if m=0 the chain is terminated with H

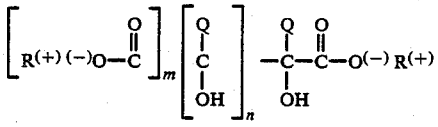

where:
Q=COO(−)R(+) or H
R=Na or K
n=0–20
m=0 or 1; if m=0 the chain is terminated with H

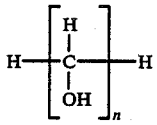

where:
n=3–20

The concentration of the iron complexing compounds in the stripping solution may range from 0.01 lbs./gal. to saturation; however, the preferred concentration is from 0.25 lbs./gal. to 0.75 lbs./gal.

According to the present invention, any one of several methods may be used to recover the dissolved nickel from the spent stripping solution, i.e., ion exchange, sulfide precipitation, pH precipitation, or preferably, direct electrochemical recovery using a diaphragm cell. After recovery of the nickel, the waster water is disposable in the sewer as it contains no toxic materials.

The present invention provides an electrical process for the removal of high-phosphorus electroless nickel plating from an article wherein the stripping solution itself is utilized in the application of a reverse current of 2 or more volts to said plated article. Stripping proceeds at the rapid rate expected in the case of a nickel coating containing no phosphorus.

The present invention provides an electrical process for the removal from articles stripped of nickel of the residual smut that ensues from sulfide ion catalysis of the chemical stripping process. In accordance with the present invention, the stripped article is reverse-plated in the stripping solution itself using the stripped article as the anode and the tank as the cathode.

The present invention is illustrated in detail in the following examples. These examples are included for illustrative purposes and should not be considered to limit the present invention.

EXAMPLE I

The following components were mixed in a mixer to obtain an off-yellow powder that was easily dissolved in water:

| Compound | Amount, lbs. |
|---|---|
| Sodium Meta-Nitrobenzene Sulfonic Acid | 27 |
| Glycine | 42 |
| Sodium Carbonate | 50 |
| Sodium Thiosulfate | 5 |

Two and one-half (2½) pounds of the resultant powder were dissolved in 1 gallon of water at a temperature of 150° F. to form a stripping solution. Several steel articles which had been electroplated with 0.0005 inches of nickel were subsequently immersed in the stripping solution at 150° F. for ½ hour. The nickel deposit was completely removed after ½ hour with no dimensional change in the base metal.

Residual black smut ensuing from the sulfide ion catalysis of the chemical stripping process was easily removed by reverse-plating the articles in the stripping solution for 30 seconds at 6 volts using the stripped article as the anode and the tank as the cathode. The stripped articles were then replated using standard procedures. The resulting plated articles could not be visually distinguished from normally plated articles. Adhesion tests showed the stripped articles to be slightly better than those not stripped.

The process of this example eliminates the use of toxic cyanides and chromic acid dips normally used to remove smut.

EXAMPLE II

Several articles plated with 0.0008 inches of electroless nickel with a phosphorous content of 9 percent were immersed in the stripping solution described in Example I at a temperature of 150° F. for 1 hour. Subsequently, half the articles were reverse-plated in the stripping solution for 30 seconds at 6 volts using the stripped article as the anode and the tank as the cathode to remove the residual smut. The articles were completely stripped of the residual smut and were easily replated. The remaining articles remained immersed in the stripping solution for a total of 3 hours. The articles immersed in the stripping solution for 3 hours were subsequently found to be smut-free and were easily replated with no special treatment.

EXAMPLE III

The following components were mixed in a mixer for 10 minutes to obtain an off-yellow power: .

| Compound | Amount, lbs. |
|---|---|
| Sodium Meta-Nitrobenzene Sulfonic Acid | 27 |
| Glycine | 42 |
| Trisodium Phosphate | 50 |
| Sodium Thiosulfate | 7 |

Two and one-half (2½) pounds of the resultant powder were dissolved in 1 gallon of water at a temperature of 150° F. to compose a stripping solution. Steel articles plated with electroless and electrolytic nickel were immersed in the stripping solution at room temperature. After 12 hours, they were completely stripped and the residual smut was removed by reverse-plating the articles in the stripping solution for 30 seconds at 6 volts using the stripped articles as the anode and the tank as the cathode.

EXAMPLE IV

A stripping solution was prepared as described in Example I. Several panels of pure nickel anode were immersed in the stripping solution and allowed to strip for 24 hours at a temperature of 150° F. After the allotted time, the solution was analyzed for nickel content. The concentration of nickel in the solution was measured at 3.96 oz./gal.

EXAMPLE V

A composition for stripping nickel-iron alloy was prepared with the following components:

| Compound | Amount, lbs. |
|---|---|
| Sodium Meta-Nitrobenzene Sulfonic Acid | 27 |
| Glycine | 42 |
| Sodium Carbonate | 50 |
| Sodium Thiosulfate | 7 |
| Sodium Gluconate | 25 |

Three (3) pounds of the resultant powder were dissolved in 1 gallon of water at a temperature of 150° F. to compose a stripping solution. Several metal articles plated with 0.0009 inches of nickel-iron alloy (with an iron content of 20 to 30 percent) were immersed in the stripping solution for 1 hour at 150° F. After the allotted time, the articles were found to be completely stripped with no attack on the base metal. The articles were subsequently reverse-plated in the stripping solution for 30 seconds at 6 volts using the stripped article as the anode and the tank as the cathode.

EXAMPLE VI

A composition for stripping nickel-iron alloy was prepared with the following components:

| Compound | Amount, lbs. |
|---|---|
| Sodium Meta-Nitrobenzene Sulfonic Acid | 27 |
| Glycine | 42 |

-continued

| Compound | Amount, lbs. |
|---|---|
| Sodium Carbonate | 50 |
| Sodium Thiosulfate | 7 |
| Disodium Tartarate | 25 |

Three (3) pounds of the resultant powder were dissolved in 1 gallon of water at a temperature of 150° F. to compose a stripping solution. Metal articles plated with 0.0009 inches of nickel-iron alloy (with an iron content of 20 to 30 percent) were immersed in the stripping solution for 1 hour at a temperature of 150° F. The articles were completely stripped in the allotted time with no attack on the base metal and were easily replated.

EXAMPLE VII

A composition for stripping nickel-iron alloy was prepared as follows:

| Compound | Amount, lbs. |
|---|---|
| Sodium Meta-Nitrobenzene Sulfonic Acid | 27 |
| Beta-Alanine | 42 |
| Sodium Carbonate | 50 |
| tetrasodium pyrophosphate | 25 |
| Sodium Thiosulfate | 7 |

Three (3) pounds of the resultant powder were dissolved in 1 gallon of water at a temperature of 150° F. to compose a stripping solution. Several articles plated with 0.0009 inches of nickel-iron alloy (with an iron content of 20 to 30 percent) were immersed in the stripping solution for 1 hour at a temperature of 150° F. At the end of that time, the articles were found to be completely stripped with no attack on the base metal. The articles were subsequently reverse-plated in the stripping solution for 30 seconds at 6 volts using the stripped article as the anode and the tank as the cathode.

EXAMPLE VIII

The following components were mixed in a mixer for 10 minutes to obtain an off-yellow powder:

| Compound | Amount, lbs. |
|---|---|
| Sodium Meta-Nitrobenzene Sulfonic Acid | 27 |
| Monosodium Glutamate | 42 |
| Sodium Carbonate | 50 |
| Sodium Thiosulfate | 5 |

Two and one-half (2½) pounds of the resultant powder were dissolved in 1 gallon of water at a temperature of 150° F. to compose a stripping solution. Steel articles plated with electroless and electrolytic nickel were immersed in the resultant stripping solution. After one hour they were completely stripped and the residual smut was removed easily by reverse-plating the articles in the stripping solution for 30 seconds at 6 volts using the stripped articles as the anode and the tank as the cathode. The stripped articles were then replated using standard procedures.

EXAMPLE IX

The following components were mixed in a mixer to obtain an off-yellow powder that was easily dissolved in water:

| Compound | Amount, lbs. |
|---|---|
| Sodium Meta-Nitrobenzene Sulfonic Acid | 27 |
| Glycine | 42 |
| Sodium Carbonate | 50 |
| Sodium Thiosulfate | 5 |

Two and one-half (2½) pounds of the resultant powder were dissolved in 1 gallon of water at a temperature of 150° F. to form a stripping solution. Several steel articles which had been electroplated with 0.0005 inches of high-phosphorus electroless nickel including a phosphorus content of 15% were subsequently immersed in the stripping solution at 150° F. for ½ hour while a reverse current was applied to said articles. Stripping proceeded at the more rapid rate expected in the case of a nickel coating containing no phosphorus. The high-phosphorus electroless nickel deposit was completely removed after ½ hour with no dimensional change in the base metal.

Residual black smut ensuing from the sulfide ion catalysis of the chemical stripping process was easily removed by reverse-plating the articles in the stripping solution for 30 seconds at 6 volts using the stripped article as the anode and the tank as the cathode. The stripped articles were then replated using standard procedures. The resulting plated articles could not be visually distinguished from normally plated articles. Adhesion tests showed the stripped articles to be slightly better than those not stripped.

What is claimed is:

1. A nickel stripping composition suitable for use in an aqueous electroless stripping bath, said nickel stripping composition consisting essentially of:
   (1) a zwitterion,
   (2) an oxidizing agent in the form of a soluble organic nitro compound,
   (3) a pH-adjusting compound selected from the group consisting of a soluble salt that forms an alkaline solution when dissolved in water, sodium hydroxide and potassium hydroxide, to adjust the stripping solution to an operating pH range of 7 to 11, and
   (4) a compound that forms the sulfide ion in solution to act as a catalyst in the chemical stripping process.

2. A nickel stripping composition according to claim 1 wherein the zwitterion is an aminocarboxylic acid.

3. A nickel stripping composition according to claim 2 wherein the soluble salt is sodium or potassium carbonate.

4. A nickel stripping composition according to claim 1 wherein the soluble salt is sodium or potassium carbonate.

5. A nickel stripping composition according to claim 1 including at least one iron complexor of the group consisting of hydroxycarboxylic acids, polyphosphates, polyols and monosaccharides.

6. A nickel stripping composition according to claim 1, wherein the zwitterion is an aminocarboxylic acid and the compound forming the sulfide ion is sodium or potassium thiosulfate.

7. A nickel stripping composition according to claim 6 wherein the soluble salt is sodium or potassium carbonate.

8. A nickel stripping composition according to claim 7 wherein the zwitterion is glycine, beta-alanine or monosodium glutamate.

9. A nickel stripping composition according to claim 1 free of volatile nitrogen containing compounds.

10. The stripping composition according to claim 1, wherein there is employed as the oxidizing agent a soluble organic nitro compound selected from the group consisting of ortho-, meta- and para-nitrobenzene sulfonic acids and their salts, and ortho-, meta- and para-nitrobenzoic acids and their soluble salts.

11. The stripping composition according to claim 1, wherein the pH-adjusting compound is a soluble salt selected from the group consisting of sodium carbonate, potassium carbonate, potassium phosphate, disodium phosphate, tripotassium phosphate, trisodium phosphate, tetrasodium pyrophosphate, dipotassium phosphate and sodium tetraborate.

12. The stripping composition according to claim 1, wherein the sulfide ion compound is sodium or potassium thiosulfate.

13. The stripping composition according to claim 1, including at least one iron complexor of the group consisting of hydroxycarboxylic acids, polyphosphates, polyols and monosaccharides, wherein the compound used to form an iron complexor is a hydroxycarboxylic acid selected from the group consisting of gluconic acid, hydroxyacetic acid, tartaric acid, malic acid, alpha- and beta-hydroxypropionic acid, citric acid, glucuronic acid and lactic acid.

14. The stripping composition according to claim 1, including at least one iron complexor of the group consisting of hydroxycarboxylic acids, polyphosphates, polyols and monosaccharides, wherein the compound used to form an iron complexor is a polyphosphate selected from the group consisting of sodium polyphosphate, sodium metaphosphate, sodium tripolyphosphate and sodium pyrophosphate.

15. The stripping solution according to claim 1, including at least one iron complexor of the group consisting of hydroxycarboxylic acids, polyphosphates, polyols and monosaccharides, wherein the compound used to form an iron complexor is a polyol selected from the group consisting of glycerine, meso-erythritol, sorbitol and mannitol.

16. The stripping solution according to claim 1, including at least one iron complexor of the group consisting of hydroxycarboxylic acids, polyphosphates, polyols and monosaccharides, wherein the compound used to form an iron complexor is a monosaccharide selected from the group consisting of fructose and glucose.

17. The stripping composition according to claim 1, including an iron complexing compound selected from the group consisting of sodium gluconate, sodium glucoheptonate, disodium tartarate, sodium glycolate, potassium sodium tartarate and disodium malate.

18. The stripping composition according to claim 17, wherein the iron complexing compound is sodium gluconate or disodium tartarate.

19. The stripping composition according to claim 1, wherein the concentration range of the zwitterion compound is from 0.01 lbs./gal. to saturation; the concentration range of the organic nitro compound is from 0.01 lbs./gal. to saturation; the concentration range of the soluble salt, potassium hydroxide or sodium hydroxide, is from 0.01 lbs./gal. to saturation; and the concentration range of the sulfite ion compound is from 1 ppm to 5 oz./gal.

20. The stripping composition according to to claim 19, including an iron complexor which is a hydroxycarboxylic acid, a polyphosphate, a polyol or a monosaccharide, the concentration of the iron complexor being from 0.01 lbs./gal. to saturation.

21. The stripping composition according to claim 19, wherein the concentration range of the zwitterion compound is from 0.5 lbs./gal. to 1.5 lbs./gal.; the concentration range of the organic nitro compound is from 0.25 lbs./gal. to 1.0 lbs./gal.; the concentration range of the soluble salt, potassium hydroxide or sodium hydroxide, is from 0.5 lbs./gal. to 1.5 lbs./gal; and the concentration range of the sulfide ion compound is from 1 oz./gal. to 3 oz./gal.

22. The stripping composition of claim 19, including an iron complexor which is a hydroxycarboxylic acid, a polyphosphate, a polyol or a monosaccharide, wherein the concentration range of the iron complexor is from 0.25 lbs./gal. to 0.75 lbs./gal.

23. The stripping composition according to claim 19, wherein the concentration range of the zwitterion compound is from 0.01 lbs./gal. to saturation.

24. The stripping composition according to claim 19, wherein the concentration range of the zwitterion compound is from 0.5 lbs./gal. to 1.5 lbs./gal.; the concentration range of the organic nitro compound is from 0.25 lbs./gal. to 1.0 lbs./gal.; the concentration range of the soluble salt, potassium hydroxide or sodium hydroxide, is from 0.5 lbs./gal. to 1.5 lbs./gal.; and the concentration range of the sulfide ion compound is from 1 oz./gal. to 3 oz./gal.

25. The stripping compound according to claim 19, wherein the concentration range of the organic nitro compound is from 0.01 lbs./gal. to saturation.

26. The stripping composition according to claim 19, wherein the concentration range of the zwitterion compound is from 0.5 lbs./gal. to 1.5 lbs./gal.; the concentration range of the organic nitro compound is from 0.25 lbs./gal. to 1.0 lbs./gal.; the concentration range of the soluble salt, potassium hydroxide or sodium hydroxide, is from 0.5 lbs./gal. to 1.5 lbs./gal.; and the concentration range of the sulfide ion compound is from 1 oz./gal. to 3 oz./gal.

27. The stripping composition according to claim 19, including a soluble salt, wherein the concentration range of the soluble salt is from 0.01 lbs./gal. to saturation.

28. The stripping composition according to claim 19, including a soluble salt, wherein the concentration range of the zwitterion compound is from 0.5 lbs./gal. to 1.5 lbs./gal.; the concentration range of the organic nitro compound is from 0.25 lbs./gal. to 1.0 lbs./gal.; the concentration range of the soluble salt is from 0.5 lbs./gal. to 1.5 lbs./gal.; and the concentration range of the sulfide ion compound is from 1 oz./gal. to 3 oz./gal.

29. The stripping composition according to claim 19, wherein the concentration range of the sulfide ion compound is from 1 ppm to 5 oz./gal.

30. The stripping composition according to claim 19, wherein the concentration range of the zwitterion compound is from 0.5 lbs./gal. to 1.5 lbs./gal.; the concentration range of the organic nitro compound is from 0.25 lbs./gal. to 1.0 lbs./gal.; the concentration range of the soluble salt, potassium hydroxide or sodium hydroxide, is from 0.5 lbs./gal. to 1.5 lbs./gal.; and the concentration range of the sulfide ion compound is from 1 oz./gal. to 3 oz./gal.

31. The stripping composition according to claim 19, including a hydroxycarboxylic acid, a polyphosphate, a polyol or a monosaccharide as an iron complexing compound in an amount of 0.01 lbs./gal. to saturation.

32. The stripping composition according to claim 19, including a hydroxycarboxylic acid, a polyphosphate, a polyol or a monosaccharide as an iron complexing compound in an amount of 0.25 lbs./gal. to 0.75 lbs./gal., wherein the concentration range of the zwitterion compound is from 0.5 lbs./gal. to 1.5 lbs./gal.; the concentration range of the organic nitro compound is from 0.25 lbs./gal. to 1.0 lbs./gal.; the concentration range of the soluble salt, potassium hydroxide or sodium hydroxide, is from 0.5 lbs./gal. to 1.5 lbs./gal.; and the concentration range of the sulfide ion compound is from 1 oz./gal. to 3 oz./gal.

33. An electrical process for the removal of high-phosphorus electroless nickel plating from an article comprising the application of a reverse current to the said plated article immersed in the stripping solution of claim 1.

34. An electrical process for the removal of high-phosphorus electroless nickel plating from an article comprising the application of a reverse current to the said plated article immersed in the stripping solution of claim 2.

35. An electrical process for the removal of high-phosphorus electroless nickel plating from an article comprising the application of a reverse current to the said plated article immersed in the stripping solution of claim 3.

36. An electrical process for the removal of high-phosphorus electroless nickel plating from an article comprising the application of a reverse current to the said plated article immersed in the stripping solution of claim 6.

37. An electrical process for the removal of high-phosphorus electroless nickel plating from an article comprising the application of a reverse current to the said plated article immersed in the stripping solution of claim 7.

38. An electrical process for the removal of high-phosphorus electroless nickel plating from an article comprising the application of a reverse current to the said plated article immersed in the stripping solution of claim 9.

39. An electrical process for the removal of residual smut from article that has been stripped of nickel comprising reverse-plating the stripped article in the stripping solution of claim 1 using the stripped article as the anode and the tank as the cathode.

40. An electrical process for the removal of residual smut from an article that has been stripped of nickel comprising reverse-plating the stripped article in the stripping solution of claim 2 using the stripped article as the anode and the tank as the cathode.

41. An electrical process for the removal of residual smut from an article that has been stripped of nickel comprising reverse-plating the stripped article in the stripping solution of claim 3 using the stripped article as the anode and the tank as the cathode.

42. An electrical process for the removal of residual smut from an article that has been stripped of nickel comprising reverse-plating the stripped article in the stripping solution of claim 6 using the stripped article as the anode and the tank as the cathode.

43. An electrical process for the removal of residual smut from an article that has been stripped of nickel comprising reverse-plating the stripped article in the stripping solution of claim 7 using the stripped article as the anode and the tank as the cathode.

44. An electrical process for the removal of residual smut from an article that has been stripped of nickel comprising reverse-plating the stripped article in the stripping solution of claim 9 using the stripped article as the anode and the tank as the cathode.

* * * * *

REEXAMINATION CERTIFICATE (1343rd)

United States Patent [19]

Coffey

[11] B1 4,720,332

[45] Certificate Issued Aug. 28, 1990

[54] NICKEL STRIP FORMULATION

[76] Inventor: Barry W. Coffey, Rte. 20, Box 683, Lenoir, N.C. 28645

Reexamination Reqs:st:

No. 90/001,588, Aug. 29, 1988
No. 90/001,610, Sep. 26, 1988

Reexamination Certificate for:

Patent No.: 4,720,332
Issued: Jan. 19, 1988
Appl. No.: 854,309
Filed: Apr. 21, 1986

[51] Int. Cl.[5] ..... C25F 5/00
[52] U.S. Cl. ..... 204/146; 252/79.4
[58] Field of Search ..... 204/146; 252/79.1, 79.4

[56] References Cited

U.S. PATENT DOCUMENTS

| | | | |
|---|---|---|---|
| 3,351,556 | 11/1967 | Tsourmas | 252/102 |
| 3,365,401 | 1/1968 | Saubestre | 252/149 |
| 4,111,767 | 12/1977 | Kawagishi | 204/146 |

*Primary Examiner*—John F. Niebling

[57] ABSTRACT

The present invention relates to the chemical stripping of nickel and nickel alloys from metallic and non-metallic substrates wherein at least one compound that is, or can form in solution, a zwitterion acts as a complexing agent for the metal being dissolved and as a buffer to control the pH of the stripping solution. The present invention discloses an electrical method for the rapid stripping of high-phosphorus electroless nickel plating. The present invention provides an electrical process for the efficient removal of the residual smut that ensues from the sulfide ion catalysis of the chemical stripping process.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 3–5, 7–8, 10–11 and 13–44 is confirmed.

Claims 1–2, 6, 9 and 12 are cancelled.

* * * * *